United States Patent [19]

Petell

[11] Patent Number: 4,749,010

[45] Date of Patent: Jun. 7, 1988

[54] ARRANGEMENT FOR A TAPPING TUBE

[76] Inventor: Ralf Petell, SF-65520 Helsingby, Finland

[21] Appl. No.: 931,750

[22] PCT Filed: Feb. 12, 1986

[86] PCT No.: PCT/SE86/00057

§ 371 Date: Oct. 8, 1986

§ 102(e) Date: Oct. 8, 1986

[87] PCT Pub. No.: WO86/04571

PCT Pub. Date: Aug. 14, 1986

[30] Foreign Application Priority Data

Feb. 12, 1985 [SE] Sweden ..... 8500632

[51] Int. Cl.[4] ..... B65B 31/00

[52] U.S. Cl. ..... 141/59; 141/115; 141/286; 141/302; 141/374

[58] Field of Search ..... 141/37–61, 141/1–12, 115, 116, 285–310, 374

[56] References Cited

U.S. PATENT DOCUMENTS 3,741,263 6/1973 Waxlax ..... 141/115

*Primary Examiner*—Houston S. Bell, Jr.

*Attorney, Agent, or Firm*—Balogh, Osann, Kramer, Dvorak, Genova & Traub

[57] ABSTRACT

The invention relates to a tapping tube intended for the filling of container-like receptacles, such as bottles, with a liquid, said tapping tube preferably communicating with a metering pump, whereby the liquid in question is intended to flow through the tapping tube and to be interrupted during removal and replacement of the receptacles in question. An arrangement for a tapping tube of this kind is made available in which above all dribbling and dripping can be prevented, especially in conjunction with the removal and replacement of the receptacles. There is connected to the tapping tube (1) a suction channel (14) which discharges in the vicinity of its lower end and which is so arranged as to be actuated in such a way as to provide a suction effect at least for the duration of the aforementioned interruption in the flow of liquid through the tapping tube.

9 Claims, 3 Drawing Sheets

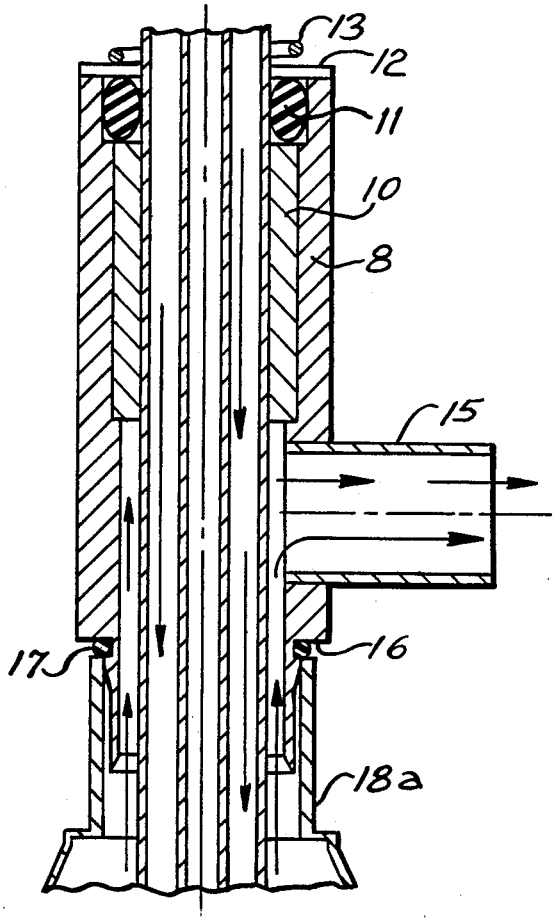
FIG.3
FIG.5
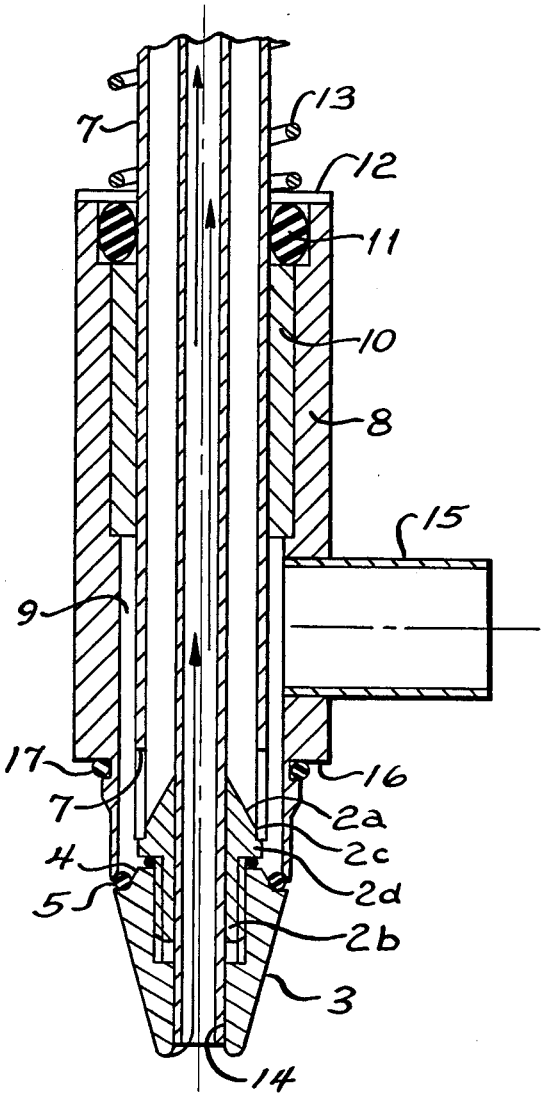

ARRANGEMENT FOR A TAPPING TUBE

The present invention relates to an arrangement for a tapping tube intended for the filling of container-like receptacles, such as bottles, with a liquid, said tapping tube preferably communicating with a metering pump, whereby the liquid in question is intended to flow through the tube and to be interrupted during removal and replacement of the receptacles in question.

Previously disclosed tapping tubes of the kind referred to above often suffer from the disadvantage that dribbling or dripping occur during removal and replacement of the receptacles, even if the flow of liquid is interrupted during this period. What this means is that liquid is spilled outside the receptacle, which poses a particularly serious problem when handling environmentally harmful liquids.

This problem is eliminated with an arrangement in accordance with the invention, which is characterized essentially in that there is connected to the tapping tube a suction channel which discharges in the vicinity of its lower end and which is so arranged as to be actuated in such a way as to provide a suction effect at least for the duration of the aforementioned interruption in the flow of liquid through the tapping tube, for the purpose of preventing dripping or dribbling during removal and replacement of the receptacles.

An illustrative embodiment in accordance with the invention is described below with reference to the accompanying drawings, in which:

FIG. 3 shows the part of the tapping tube arrangement in accordance with FIG. 2 situated adjacent to the neck of the bottle;

FIG. 5 shows the lower part of the tapping tube arrangement in accordance with FIG. 1.

Figure 1:
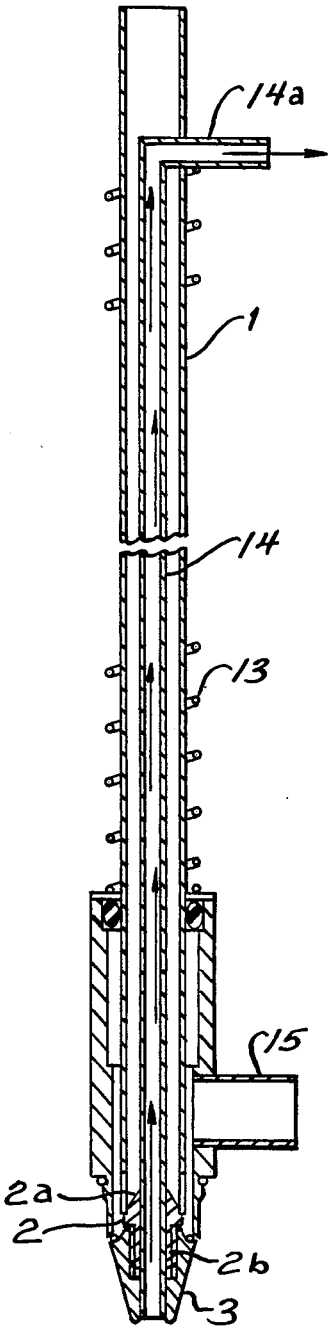
FIG. 1 shows a tapping pipe 1 fitted with the arrangement in accordance with the invention in an inactive state, that is to say when filling is not taking place.

The reference designation 1 is used in FIG. 1 to indicate in its entirety a so-called tapping tube, that is to say a tube through which the liquid which is to be introduced into a container-like receptacle, such as a bottle in the illustrative embodiment shown, is caused to flow, preferably under the control of a metering pump or some other metering arrangement which may be of a previously disclosed kind and may be attached to a line connected to the upper end of the tapping tube. Since the invention is not affected directly by this arrangement, which may, furthermore, be of a previously disclosed kind, there is no reason to describe it in more detail here. The tapping tube 1 exhibits at the bottom an end seal consisting of a body 2, which internally inside the tapping tube exhibits an upper cone-shaped part 2*a* which widens out in the downward sense and which exhibits an externally threaded part 2*b* at the bottom. Screwed securely onto the thread of the end sealing body 2 at the bottom is a guide cone 3, which tapers in a downward sense from an upward-facing shoulder 4 which forms the base for a sealing ring 5 of the 'O'-ring type. The upward-facing end surface of the guide cone 3 is sealed against a downward-facing shoulder on the end sealing body by means of a further sealing ring 6 of the 'O'-ring type. The cone 2*a* of the end sealing body is terminated at the bottom by a cylindrical part 2*c* before the flange 2*d*, which forms the shoulder against which the sealing ring 6 makes contact. The cylindrical part 2*c* has a diameter which corresponds to the internal diameter of the tapping tube 1, in which case the end sealing body with the cylindrical part 2*c* is pressed or screwed into the tapping tube 1. The tapping tube exhibits wall openings 7 distributed around its periphery adjacent to the end sealing body. The reference designation 8 is used to identify a sliding sleeve surrounding the lower part of the tapping tube, which internally exhibits a slightly larger diameter than that of the tapping tube, so as to form an annular space 9 between the tapping tube and the inner wall of the sliding sleeve, which is terminated at the top by a bearing sleeve 10 pressed into or in some other way attached to the sliding sleeve. Positioned in a recess in the upper end part of the sliding sleeve is a sealing ring 11 which forms a seal between the sliding sleeve and the tapping tube 1. Held in position against the upper end of the sliding sleeve by means of a thrust washer 12 is the lower end of a compression spring 13 of the helical type, the upper end of which is in contact with a stop situated towards the top of the tapping tube 1, such as an end part 14*a* of a suction tube 14 projecting through the tapping tube, extending down through the tapping tube centrally inside it, and passing through a central hole in both the end sealing body 2 and the guide cone 3, at the lower end of which said suction tube emerges. The compression spring 13 endeavours to hold the sliding sleeve 8 with its lower end edge in contact with the upper shoulder 4 of the guide cone via the sealing ring 5. Beneath the bearing sleeve 10 the wall of the sliding sleeve 8 is penetrated by a pipe stub 15, which forms a communication between the annular space 9 and, for example, a collection vessel for foam, excess liquid or similar. The outlet stub for the suction line should preferably be connected to a suction pump, which may be of a previously disclosed kind, preferably being a suction pump so arranged as to operate intermittently, that is to say with an interruption during the filling operation, but which is in operation during the period of removal and replacement of the receptacles to be filled.

The function of the arrangement is described below in conjunction with the filling of bottles with a comparatively narrow neck, that is to say a neck which is only slightly larger than the external diameter of the lower end part of the sliding sleeve 8 which is transformed into a downward-facing stop 16, adjacent to which a sealing ring 17 of the 'O'-ring type is positioned.

Figure 2:
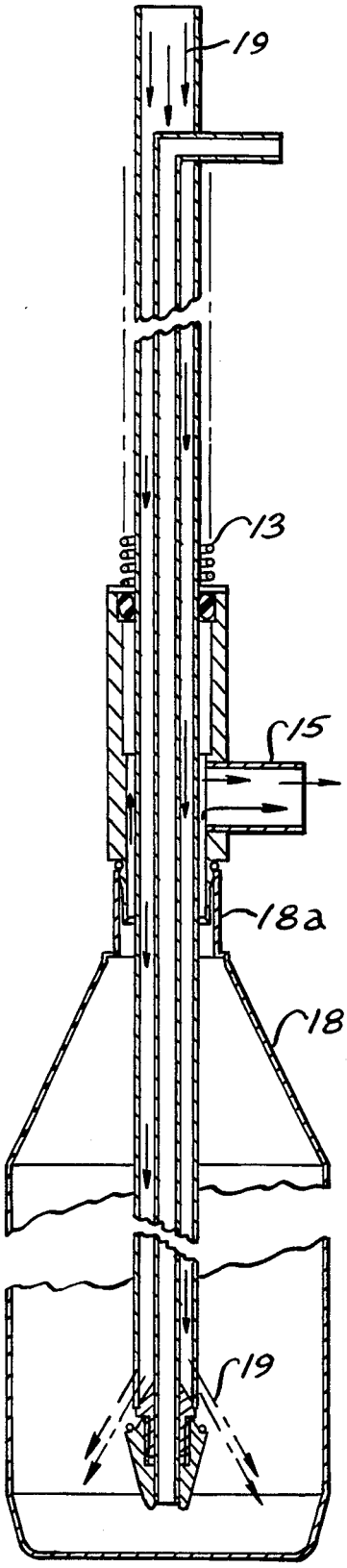
FIG. 2 shows the same tapping tube arrangement in an active state, that is to say introduced down into a bottle intended for filling.
Figure 4:
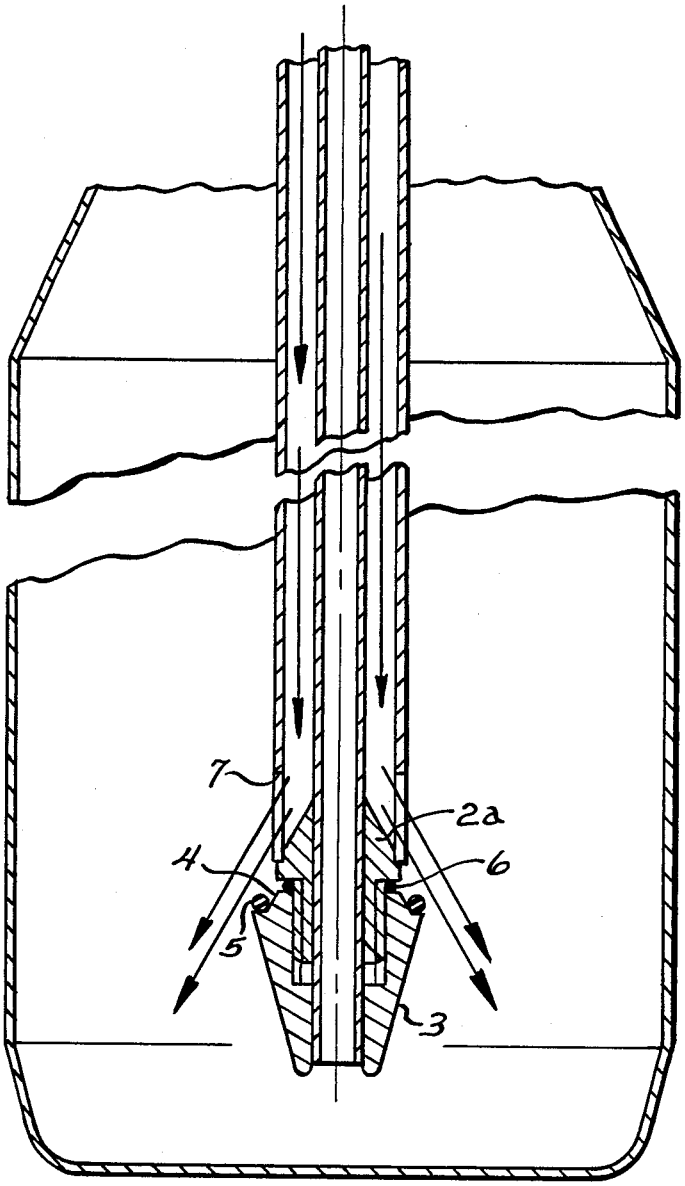
FIG. 4 shows the lower part of the tapping tube arrangement in accordance with FIG. 2 introduced down into the bottle.

It is assumed that a bottle has been filled, that the tapping tube has been raised by a sufficient amount for the guide cone 3 to be situated above the neck opening of the bottles in question, and that a new bottle has been moved into position either with the help of an appropriate feeding arrangement or manually. The suction tube 14 will now be under negative pressure via the outlet stub 14*a* produced by a suction pump of an appropriate kind. Any liquid remaining from the previous filling operation will be sucked away through the suction tube, thus preventing dribbling or drips from falling from the lower end of the guide cone 3 during removal and replacement of the receptacles. Once a new bottle 18 has been positioned beneath the tapping tube, the entire unit is lowered down into the bottle and into the position shown in FIG. 2. At the start of the downward movement the outer conical surface of the guide cone 3 will help to ensure effective guidance into the neck opening of the bottle. Once the upper edge of the neck 18*a* of the bottle has come into contact with the downward-facing stop 16 on the sliding sleeve via the sealing ring 17, the sliding sleeve will be retained in this contact position against the effect of the bias of the compression spring 13, whilst the tapping tube will continue its downward movement into the bottle, preferably as far as the position shown in FIG. 2. This continued movement will cause the contact between the lower end edge of the sliding sleeve 8 and the upward-facing shoulder of the guide cone 3 to cease, and the inside of the tapping tube will thus come into open communication with the internal space of the bottle 18. Once the tapping tube has reached its position introduced down inside the bottle, the metering arrangement, which may be a piston pump, for example, which communicates with the tapping tube will be set in operation, which means that the liquid with which the bottle is to be filled will flow down in the direction of the arrows 19 inside the tapping tube and out into the bottle. The flow of liquid is deflected gently at the bottom before it exits into the bottle thanks to the conical upper surface 2*a* of the end sealing body 2, and thanks to the fact that the discharge openings 7 are arranged immediately adjacent to the conical surface. Foaming in conjunction with discharging of the liquid is reduced to a minimum in this way. Because the contact between the sliding sleeve 8 and the upper edge of the guide cone 3 has ceased, the inside of the bottle 18 is now also connected via the outlet stub 15 with a collecting vessel for receiving any excess liquid and possibly foam which has formed inside the bottle. The aforementioned metering equipment shall preferably be adjusted in such a way that the desired level of filling is achieved in the bottle. Over-filling will thus occur only in the event of a fault arising in the metering equipment. The outlet stub 15 also serves as the exit route for any gases which may have formed inside the bottle, which can be dealt with in an environmentally harmless fashion for the surroundings and for the staff working in the filling plant. Once the metering arrangement has pumped the appropriate quantity through the tapping tube 19, the arrangement is raised and the sliding sleeve 8 will again come into contact with the guide cone and will thus interrupt the passageway not only between the inside of the tapping tube and the surroundings, but also between the inside of the bottle or the surroundings and the pipe stub 15.

The invention is not restricted to the above design, which is described only as an example, but may be modified in respect of its detail features within the scope of the following Patent Claims without departing from the fundamental idea of invention. The metering arrangement may thus be of any appropriate kind. It need not, therefore, be a piston pump, as stated in the specification. The metering arrangement need not be a pump at all. The tapping tube need not be be so arranged as to execute a reciprocating upwards and downwards movement, but filling could take place with the tapping tube stationary at a point above the neck of the bottle or the opening to the recipient in question, which may naturally also be a vessel which does not resemble a bottle, such as a vessel with a large opening.

I claim:

1. An arrangement for a tapping tube intended for the filling of container-like receptacles, such as bottles (18), with a liquid, said tapping tube preferably communicating with a metering pump, and arranged to carry out a reciprocating vertical movement in relation to the receptacles (18) in question in connection to the object change, whereby the liquid in question is intended to flow through the tapping tube and to be interrupted during replacement of the receptacles in question, characterized in that there is connected to the tapping tube (1) a suction channel (14) which discharges in the lowest point of said tapping tube and which is so arranged as to be actuated in such a way as to provide a suction effect at least for the duration of the afore-mentioned interruption in the flow of liquid through the tapping tube (1), by means of control arrangements which are provided for the activation of the suction channel (14) only in conjunction with the interruption of the flow of liquid through the tapping tube (1), for example during removal and replacement of the receptacles, for the purposes of preventing dribbling or dripping during removal and replacement of the receptacles, wherein in combination therewith there is present, with the tapping tube (1) in its position lowered into the receptacle (18) to a position capable of being below the liquid level in the receptacle, an open discharge outlet (15) operated above the liquid level for foam, excess liquid and gas.

2. An arrangement according to claim 1, characterized in that the tapping tube (1) exhibits at its base a number of discharge openings (7) which preferably are several in number and are arranged around the circumference of the tube, in which case the status of the discharge openings (7) in the tapping tube (1), i.e. the opening position, is regulated by a valve body (8) which is spring-loaded against the closed position and is so arranged as to be moved into its opening position against the aforementioned spring bias through contact being made with the receptacle (18), against the edge of the neck in the case of a bottle, as the tapping tube (1) describes its downward movement in relation to the mouth of the receptacle.

3. An arrangement according to claim 2, characterized in that the tapping tube (1) exhibits at its base an end connection (2), preferably in the form of a cone (2*a*) which widens out internally in a downward sense, around the periphery of which the discharge openings (7) of the tapping tube are arranged, in which case the valve body (8) consists of a sliding sleeve so supported as to be capable of being displaced around the tapping tube and spring-loaded in the downward direction, said sleeve being capable of coming into contact at its base and of making a seal with an annular valve seat situated beneath the discharge openings (7) of the tapping tube (1), and in addition exhibiting a stop (16) which interacts with the receptacle (18), preferably with its mouth part, for the purpose of retaining the valve sleeve during the downward movement of the tapping tube into the receptacle, and thus of forcing the discharge openings to be exposed.

4. An arrangement according to claim 3, characterized in that the valve sleeve (8) is so arranged as to come into contact with and make a seal with the receptacle (18) during filling, and thus to constitute with its inside together with the tapping tube (1) a space communicating with the inside of the receptacle, in which case the wall of the valve sleeve is penetrated by an outlet channel (15) for the removal of, for example, excess liquid and foam, etc.

5. An arrangement according to any of the preceding claims, characterized in that the suction channel (14) consists of a pipe arranged inside the tapping pipe and coaxially with it and which discharges centrally at the lower end part of the tapping pipe.

6. An arrangement according to claim 5, characterized in that the lower mouth of the suction channel (14) is situated inside an outlet body (2, 3) which closes off the tapping tube at its bottom end and which tapers externally in the downward sense, and along the upper part of which the mouth (7) of the tapping tube is situated.

7. An arrangement according to claim 2, characterized in that the suction channel consists of a pipe arranged inside the tapping pipe and coaxially with it and which discharges centrally at the lower end part of the tapping pipe.

8. An arrangement according to claim 3, characterized in that the suction channel consists of a pipe arranged inside the tapping pipe and coaxially with it and which discharges centrally at the lower end part of the tapping pipe.

9. An arrangement according to claim 4, characterized in that the suction channel consists of a pipe arranged inside the tapping pipe and coaxially with it and which discharges centrally at the lower end part of the tapping pipe.

* * * * *